United States Patent [19]

Halter

[11] Patent Number: 4,498,662

[45] Date of Patent: Feb. 12, 1985

[54] ADJUSTABLE PIPE CLAMP HOLDERS

[76] Inventor: Wilbur C. Halter, 3348 Uniontown Rd., Uniontown, Md. 21157

[21] Appl. No.: 491,273

[22] Filed: May 4, 1983

[51] Int. Cl.[3] ..... B25B 1/00

[52] U.S. Cl. ..... 269/101; 269/296; 269/283

[58] Field of Search ..... 269/900, 902, 139, 283, 269/100, 101, 287, 296, 43; 403/399, 398, 391, 386, 384; 108/124

[56] References Cited

U.S. PATENT DOCUMENTS

| | | | |
|---|---|---|---|
| 568,543 | 9/1896 | Parks | 269/902 |
| 807,315 | 12/1905 | Perron et al. | 269/902 |
| 1,625,251 | 4/1927 | Fodge | 269/287 |
| 2,891,296 | 6/1959 | Darde | 403/391 |
| 3,401,653 | 9/1968 | Knoblock | 108/124 |
| 3,561,376 | 2/1971 | Knoblock | 108/124 |
| 4,386,767 | 6/1983 | Dyckes et al. | 269/296 |
| 4,415,149 | 11/1983 | Rees | 269/100 |

FOREIGN PATENT DOCUMENTS

| | | | |
|---|---|---|---|
| 40233 | 9/1887 | Fed. Rep. of Germany | 269/100 |
| 785128 | 10/1957 | United Kingdom | 403/399 |

*Primary Examiner*—Robert C. Watson
*Attorney, Agent, or Firm*—Don E. Ferrell

[57] ABSTRACT

Adjustable pipe clamp holders may be fixedly positioned within existing apertures on the work surface of a workbench. The holders are designed for locking engagement with pipe clamps so as to lock the pipe clamps to the workbench. Through the adjustable rotatable positioning of the clamp holders in certain selected apertures, the pipe clamps may be securely locked in any desired angular position on the workbench, thus to facilitate the desired positioning of a workpiece within the jaws of the pipe clamp.

2 Claims, 5 Drawing Figures

FIG. 1
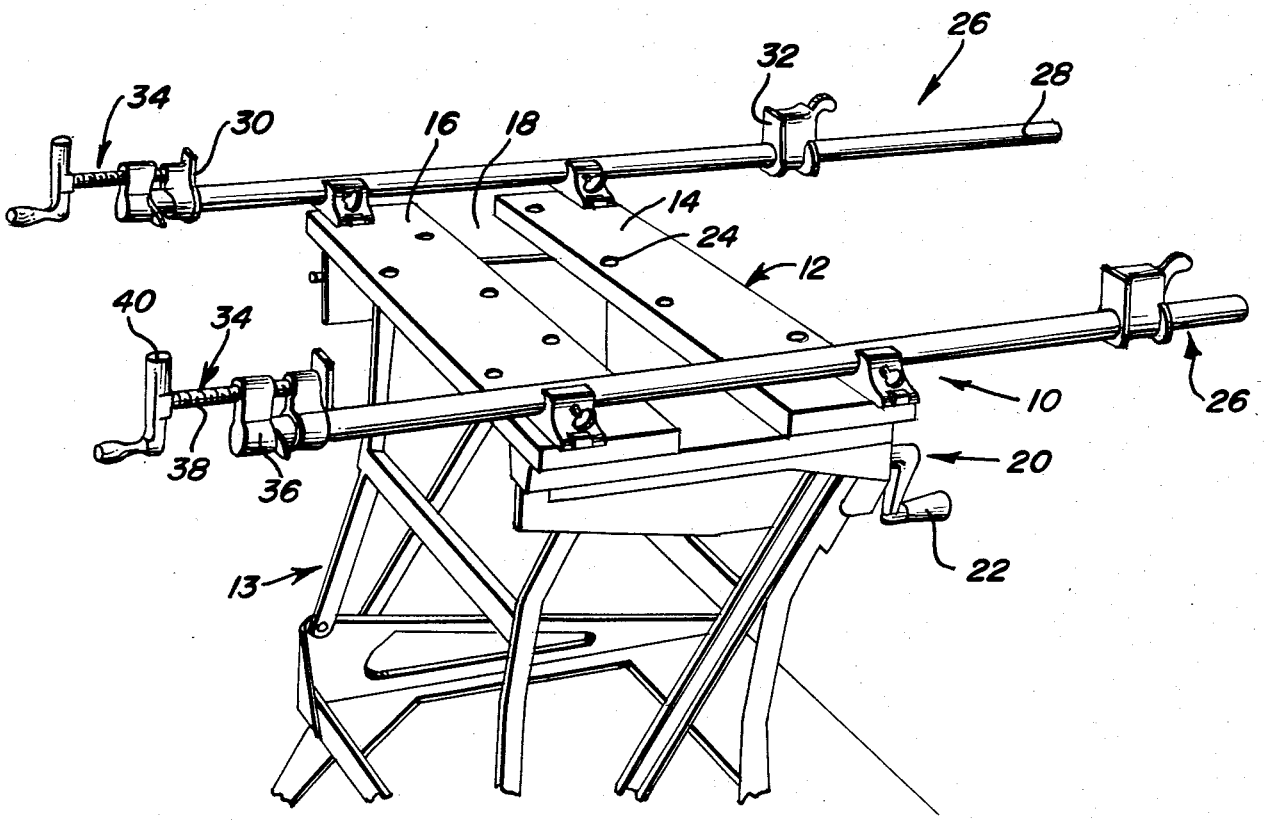
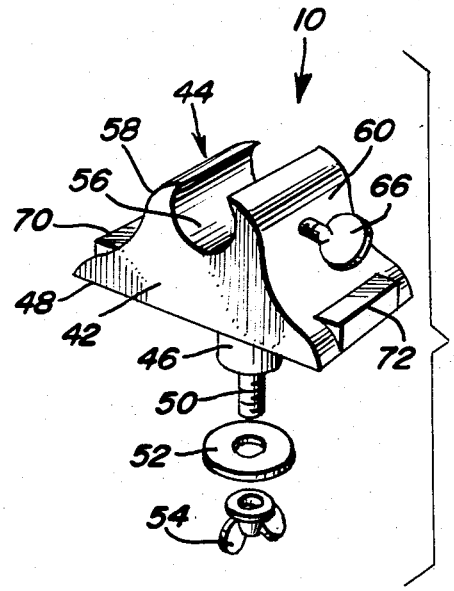
FIG. 2

ADJUSTABLE PIPE CLAMP HOLDERS

FIELD OF THE INVENTION

This application relates to Disclosure Document No. 099815 filed by the inventor of the present invention on May 4, 1981, such document being incorporated by reference herein.

The present invention relates to a new and useful tool to be used in combination with a workbench and more particularly pertains to an adjustable pipe clamp holder which is selectively fixedly securable to a workbench surface and is further fixedly securable to an adjustable pipe clamp, thereby to retain such adjustable pipe clamp in a desired fixed angular relationship with a workbench surface.

DESCRIPTION OF THE PRIOR ART

Adjustable pipe clamps are well known in the art. For example, U.S. Pat. No. 1,241,215, which issued to Hoffman on Sept. 25, 1917, evidences the early design and use of such clamps. These clamps are typically used in situations where large pieces of furniture, such as table tops or the like, need to be held in a fixed working position while being secured together by some conventional attaching means, such as gluing, etc. In those situations where the item being worked upon is positioned upon a work surface, such as a permanently positioned or folding workbench, it becomes desirable to provide some means of securely retaining the item on the workbench surface while an associated clamping operation is being performed. As can be appreciated, where an item is particularly large or cumbersome to handle and where a workbench surface area is limited, substantial difficulty may be encountered in attempting to retain the item on the workbench surface while effectively positioning and utilizing the adjustable pipe clamps.

As such, it can be appreciated that there exists a substantial need for new and improved means for retaining large items on workbench surfaces while at the same time permitting the use of adjustable pipe clamps without any danger of the item falling from the work surface or from becoming misaligned so as to severely damage the quality of the performed work. In this respect, the present invention substantially fulfills this need.

SUMMARY OF THE INVENTION

The general purpose of the present invention, which will be described subsequently in greater detail, is to provide a new and improved means for effectively securing adjustable pipe clamps to a working surface, wherein such means has all of the advantages of any existing prior art attachment means and none of the disadvantages. To attain this, recognition is made of the fact that workbench surfaces are often conventionally provided with or may be altered to have a plurality of perpendicularly-directed, through-extending apertures. The present invention comprises holders having a body portion with a pipe-retaining opening formed therein, such opening being designed to receive an adjustable pipe clamp in a fixed and secure manner, and further includes a post integrally attached thereto. The post is designed to be positioned through an existing aperture in a workbench surface, while a bottommost portion of the post is of a threaded, reduced diameter thereby to permit the positioning of a washer and wing nut thereover so as to selectively fixedly secure the holder to the workbench surface. In this respect, the threaded portion of the post extends completely through the workbench surface whereby a clamping action can be achieved between the body portion of the holder and the aforementioned washer with such clamping action being attained by a tightening of the wing nut.

With respect to the pipe-retaining opening formed in the body portion of the holder, the opening is essentially of a circular construction having one wall portion thereof removed, while such opening is envisioned as normally being of a greater diameter than the diameter of a pipe associated with an adjustable pipe clamp to be attached thereto. The adjustable pipe clamp may then be inserted within the opening and once positioned as desired, the pipe clamp may be locked in position by means of a thumb screw which threadably extends through the pipe-retaining opening wall. In this connection, the thumb screw may be threadably directed into the opening to effectively force the adjustable pipe clamp into a secure frictional engagement with an opposed wall surface of the opening.

Any number of the holders comprising the present invention may be utilized to effectively secure one or more adjustable pipe clamps in position on a workbench surface depending, of course, on the number of apertures extending through the surface, while the holders can be angularly rotated about their posts to further provide flexibility with respect to positioning.

It is therefore an object of the present invention to provide new and useful adjustable pipe clamp holders which have all of the advantages of prior art clamp holding means and none of the disadvantages.

It is another object of the present invention to provide new and useful adjustable pipe clamp holders which may be easily and efficiently manufactured and which may be assembled and used in a rapid and easily understood manner.

It is a further object of the present invention to provide new and useful adjustable pipe clamp holders which will prove to be of a durable and rugged construction under repeated use situations.

Even another object of the present invention is to provide a new and useful adjustable pipe clamp holder which is susceptible of a low cost of manufacture with regard to both materials and labor, and which accordingly is then susceptible of low prices of sale to the consuming public, thereby making such construction economically available to the buying public.

Still yet another object of the present invention is to provide a new and useful adjustable pipe clamp holder which provides in the apparatuses and methods of the prior art some of the advantages thereof, while simultaneously overcoming some of the disadvantages normally associated therewith.

An even further object of the present invention is to provide a new and useful adjustable pipe clamp holder which may be employed to effectively and securely attach adjustable pipe clamps to a working surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIG. 1 is a perspective view showing the adjustable pipe clamp holders forming the present invention operably attaching adjustable pipe clamps to a folding workbench.

FIG. 2 is an exploded perspective view of the holder forming the present invention.

DESCRIPTION OF THE PREFERRED EMBODIMENT

Figure 3:
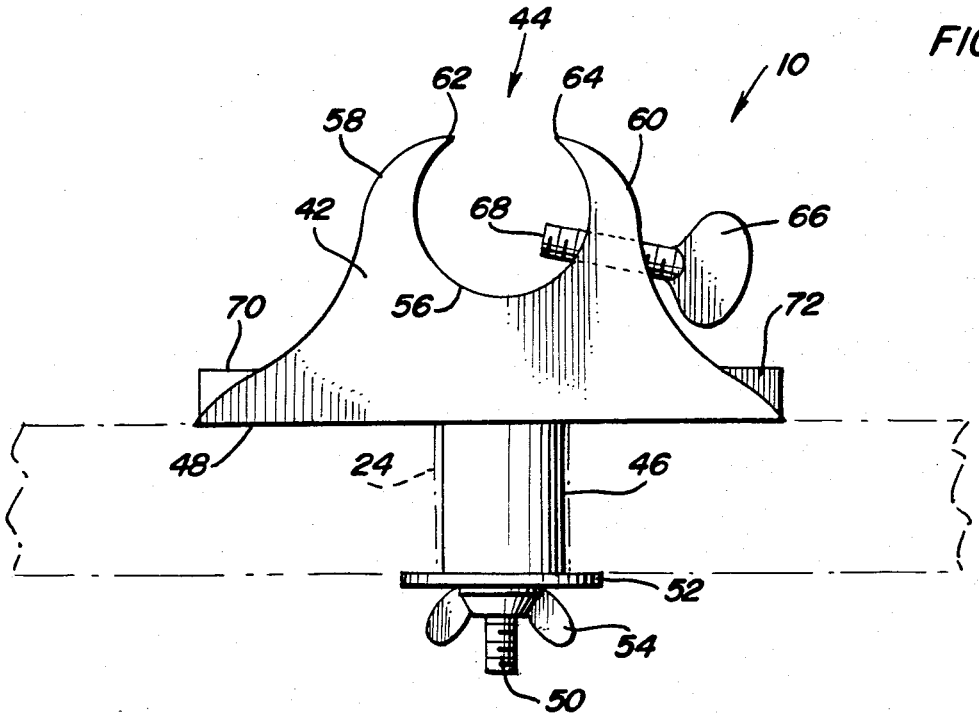
FIG. 3 is a front elevation view of the adjustable pipe clamp holder forming the present invention.
Figure 4:
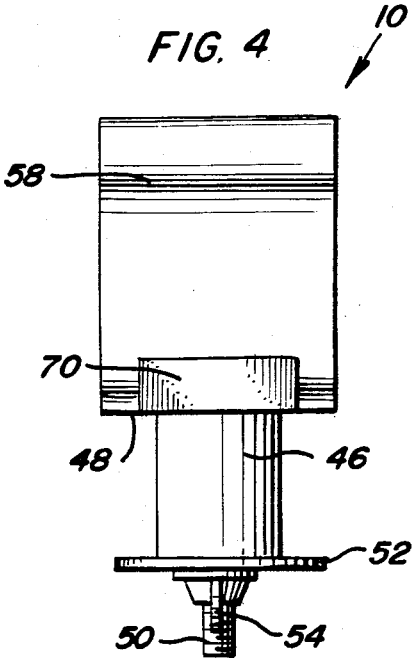
FIG. 4 is a side elevation view of the present invention.
Figure 5:
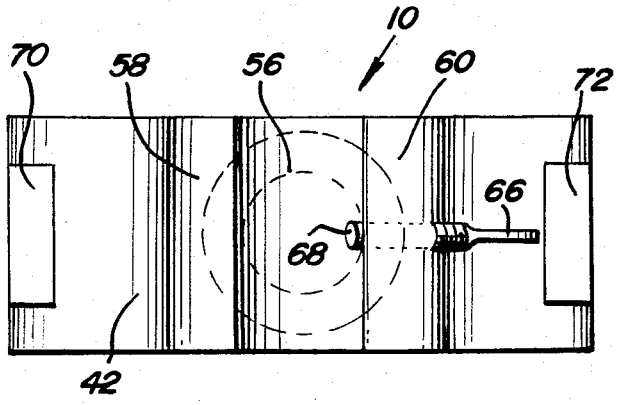
FIG. 5 is a top plan view of the invention.

With reference now to the drawings and in particular to FIG. 1 thereof, a new and useful adjustable pipe clamp holder embodying the principles and concepts of the present invention and generally designated by the reference numeral 10 will be described. In this respect, shown in FIG. 1 is a conventional foldable workbench 12 which is of a known and commercially available construction, one such brand being marketed under the tradename "Workmate." Typically, these conventional workbenches 12 include an upstanding leg support structure 13 to which is fixedly secured a pair of relatively adjustable boards 14, 16 that form a working surface. The boards 14, 16 are selectively displaceable from one another so as to control the width of a space 18 positioned therebetween, such relative movement of the boards being controlled by a threaded adjustment means 20 operated by a handle 22. In this respect, one of the boards 14, 16 may be attached to an internally threaded sleeve which may be driven along the threaded adjustment means 20 in response to a rotation of the handle 22. As can be appreciated, the boards 14, 16 with space 18 therebetween may be used as a clamp by inserting portions of items retained on the working surface into the space and then effectively bringing the two boards 14, 16 into engagement with the item through use of the threaded adjuster 20.

Additionally, these conventional workbenches 12 are normally provided with a plurality of apertures 24 which are perpendicularly-directed to the working surface of the workbench and which extend completely through the boards 14, 16. Of course, with respect to workbenches not having through-extending apertures 24, inasmuch as the working surfaces of such workbenches are normally formed from wooden boards, it is a simple matter to drill any number of such apertures at desired locations.

FIG. 1 further illustrates a pair of adjustable pipe clamps 26 positioned across the working surface of the workbench 12. The adjustable pipe clamps 26, which are of a conventional and commercially-available construction, each include an elongated length of heavy duty pipe 28 and a pair of work gripping jaws 30, 32. Typically, the jaws 32 may be selectively positioned along a length of the pipe 28 and may then be fixedly secured thereto by some provided conventional attachment means. These jaws 32 then constitute one gripping surface which will be fixedly retained in position on the adjustable pipe clamp 26 once a certain working position has been selected. With respect to the jaws 30, however, the same are slidably positionable along the length of the pipe 28 and are movable into a desired position by means of a threaded adjustment means 34. More particularly, the threaded adjustment means 34 includes a guiding member 36 fixedly secured to an end of the pipe 28, such guiding member having an internally threaded aperture through which a screw member 38 may be threadably directed. The screw member 38 is in fixed engagement with the jaw 30 by means of an unillustrated bearing surface which permits a rotation of the screw member 38 without a concurrent rotation of the jaw. As such, when the screw member 38 is rotated by means of handle 40, a movement of the member through the guiding member 36 occurs and, inasmuch as the screw member is bearingly attached to the jaw 30, a concurrent sliding movement of the jaw along the pipe 28 results. As is apparent then, a clockwise rotation of the screw member 38 will effect a movement of the jaw 30 along the pipe 28 into engagement with an item which might be selectively positioned between the jaws 30, 32, thereby to effect a desired clamping action. A typical use of such adjustable pipe clamps 26 is to effect the gluing together of a plurality of boards, such as when it is desired to manufacture a table top or some similar structure.

With respect to the structure thus far described, i.e., a foldable workbench 12 and an adjustable pipe clamp 26, it is to be understood that the same are of a conventional and known construction and constitute no part of the present invention. Turning now to the construction of the present invention, it can be seen in FIG. 1 that it may on occasion be desirable to attach one or more adjustable pipe clamps 26 to a workbench 12 in the manner shown. This becomes particularly desirable where a large and unwieldy item is being glued together or otherwise worked upon through the use of adjustable pipe clamps 26 and where such item must be supported upon a small working surface as disclosed on the workbench 12. In this regard, it can be seen that the holders 10 may be selectively positioned on and fixedly secured to the boards 14, 16 by attaching the holders through the provided apertures 24. Further, it can be seen that the adjustable pipe clamps 26 may then be selectively fixedly positioned within the holders 10 so as to prevent the clamps from becoming disengaged from the workbench surface. As such, a secure working engagement of an item can be achieved with the adjustable pipe clamps 26 without any concern that the item, or the clamps attached thereto, will fall from the workbench 12.

With reference now to FIG. 2, 3, 4 and 5 of the drawings, the specific structural details of the present invention will be described. In this regard, it can be seen that the holder 10 includes a body portion 42 having a pipe-retaining opening 44 and an attachment post 46. As illustrated, the body portion 42 further includes a flat, planar bottom supporting surface 48 which is designed to rest against the topmost surface of a board 14, 16 while the aforementioned attachment post 46 extends orthogonally outwardly therefrom, such attachment post being designed to be inserted into an aperture 24 on one of the boards 14, 16.

Inasmuch as the holder 10 is normally envisioned as being of a complete integral construction, such as being manufactured from heavy, industrial quality, cast aluminum, a lowermost portion of the attachment post 46 is machined to a lesser diameter, such machining including the forming of screw threads 50 thereon. The screw threads 50 are designed to permit the positioning of a washer 52 and wing nut 54 thereover.

With respect to the pipe-retaining opening 44, it can be seen that the same is of a substantially circular configuration and is defined by a pair of upstanding, curvilinear members 58, 60. The upstanding members 58, 60 are shaped to form the pipe-retaining opening 44 and terminate at respective topmost edges 62, 64. Inasmuch as the pipe-retaining opening 44 is formed from a cylindrically-shaped discontinuous wall surface 56, the edges 62, 64 define a space therebetween whereby a pipe 28 retained within the opening 44 will extend outwardly from the opening 44 and above the uppermost edges 62, 64. This construction prevents interference between the body portion 42 of the holder 10 and an item retained between the jaws 30, 32 of an adjustable pipe clamp 26, once the pipe clamp has been fixedly positioned within the holder.

Of course, it is to be understood that the pipe-retaining opening 44 is designed to be of a slightly larger diameter than a length of pipe 28 associated with an adjustable pipe clamp 26, thereby to permit an unencumbered attachment of the pipe clamp to the holder. To facilitate a fixed securement of a length of pipe 28 within the pipe-retaining opening 44, the upstanding member 60 is provided with a through-extending threaded aperture into which a thumb screw 66 may be threadably positioned. The thumb screw 66, as best shown in FIG. 3, may be threadably moved through the aperture in the member 60 until an end portion 68 of the thumb screw extends into the pipe-retaining opening 44. By the same token, a counterclockwise rotation of the thumb screw 66 will result in the end portion 68 moving back into the member 60, thus to present no obstruction within the opening 44.

Another novel feature of the present invention shown in FIGS. 2, 3, 4 and 5 are the integrally cast, upraised, substantially rectangular end portions 70, 72 which are designed to increase the rigidity of the bottom surface 48 proximate the respective ends thereof. As shown, the cast end portions 70, 72 extend almost entirely across the entire width of the body portion 42 thereby to add the strength and rigidity required for retaining adjustable pipe clamps which are subject to substantial leverage forces during use.

With respect to the manner of utilizing the present invention, it can be seen that where a user wishes to attach one or more adjustable pipe clamps 26 to the surface of a workbench 12, he need only to remove the washer 52 and wing nut 54 from the holder and then insert the attachment post 46 downwardly through a selected aperture 24 on the workbench working surface. As can be appreciated, the attachment post 46 effectively constitutes a bearing surface whereby the holder 10 may be rotated about the axis of the attachment post so as to permit a desired alignment of the pipe-retaining opening 44. Once the holder 10 is selectively positioned, the screw threads 50 should extend outwardly beyond the bottom surface of the workbench working surface whereby the washer 52 may be positioned over the threads and the wing nut 54 may then be utilized to threadably force the washer into engagement with the bottommost surface of the workbench 12. Through a tightening of the wing nut 54, the bottom surface 48 of the holder 10 will be brought into secure frictional clamping engagement with the workbench surface.

The thumb screw 66 may then be rotated in a counterclockwise manner until the end portion 68 thereof moves out of the pipe-retaining opening 44 and an adjustable pipe clamp 26 having its jaw 32 temporarily removed may then have its pipe portion 28 axially directed through the opening 44 to effect a retention thereof. Once the adjustable pipe clamp 26 is aligned as desired, the thumb screw 66 may be rotated in a clockwise manner as a result of which the end 68 of the screw will forcibly engage the pipe 28, thereby to force the pipe into a tight frictional engagement with the upstanding member 58 forming one side of the opening 44. The jaw member 32 may then be re-attached to the pipe 28 to complete the adjustable pipe clamp 26 assembly and of course, further selective positioning and adjustment of the pipe clamp can be achieved through selective loosening and re-tightening of the wing nut 54 and the thumb screw 66. As shown in FIG. 1, where one or more adjustable pipe clamps 26 are utilized, a smooth and continuous working surface is achieved along a topmost-located surface of the pipes 28 due to the fact that the outer circumferential surfaces of the pipes 28 are permitted to extend outwardly from the openings 44 and above the topmost edges 62, 64 thereof. This construction then prevents scratching or other interference with an item retained between the clamp jaws 30, 32 as might otherwise be occasioned if the holders 10 extended above the pipe working surface.

Inasmuch as the holders 10 constitute the present invention, it is to be understood that there is no intention to limit the use of the holders strictly to permanently mounted or portable foldable workbenches, but rather such use could be in conjunction with any conceivable working surface to which the holders could be attached. Further, although the holders have been described in conjunction with adjustable pipe clamps so as to shorten the functional description thereof, it is envisioned that the holders could be utilized for various other conceivable purposes. For example, they could be utilized to hold a length of pipe on a working surface while the pipe is being cut, threaded, etc. By the same token, the clamps could be utilized to permanently retain various fixtures in a desired position, such as shop lamps and the like. Additionally, while the holders 10 have been described as being manufactured as an integral cast aluminum construction, it is also envisioned that such holders could be made of separable parts and from two or more different materials. For example, it might on certain occasions be desirable to construct the body portion 42 of an elastomeric composition while utilizing a metallic composition for the attachment post 46. Additionally, the screw threads 50 could constitute a cast or molded in place commercially available bolt. In this regard, these brief examples represent the numerous combinations of materials and methods of manufacture envisioned by the inventor.

With respect to the above-description then, it should be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A holding apparatus for effecting an attachment of an adjustable pipe clamp or the like to a working surface, such as the working surface of a folding workbench or the like, said holding apparatus comprising:

a body portion;

a substantially cylindrical aperture directed through said body portion, said substantially cylindrical aperture being designed to retain said adjustable pipe clamp therein;

interference prevention means, said interference prevention means comprising a through-extending slot cut into said substantially cylindrical opening whereby an internal wall portion of said substantially cylindrical opening is discontinuous, thereby to permit a circumferential surface of said adjustable pipe clamp to extend outwardly from said substantially cylindrical opening and above a topmost portion of said body portion;

clamping means, said clamping means comprising a threaded member selectively movable into and out of said substantially cylindrical opening, said threaded member being selectively brought into engagement with said adjustable pipe clamp retained within said substantially cylindrical opening, thereby to frictionally engage and retain said adjustable pipe clamp within said opening;

attachment post means, said attachment post means extending out of a bottommost portion of said body portion and being positionable through an opening provided in said working surface, thereby to retain said body portion at a desired location on said working surface, said attachment post means including a substantially smooth surfaced cylindrical portion and a threaded end portion; and working surface attachment means, said working surface attachment means including a washer means positionable over said threaded end portion of said attachment post means and being engageable with a bottommost surface of said working surface and further including an internally threaded member positionable over said threaded end portion, said internally threaded member being operable to force said washer into engagement with said bottommost surface of said working surface, thereby to frictionally secure said holding apparatus in a particular desired location.

2. The holding apparatus for effecting an attachment of an adjustable pipe clamp or the like to a working surface as described in claim 1, and further including cast end portions integrally attached to said body portion, said cast end portions extending substantially across an entire width of said body portion, thereby to increase the strength and rigidity of said holding apparatus.

* * * * *